United States Patent [19]

Farnand et al.

[11] 4,029,567

[45] June 14, 1977

[54] SOLIDS RECOVERY FROM COAL LIQUEFACTION SLURRY

[75] Inventors: Joseph Redmond Farnand; Ira Edwin Puddington, both of Ottawa, Canada

[73] Assignee: Canadian Patents and Development Limited, Ottawa, Canada

[22] Filed: Apr. 20, 1976

[21] Appl. No.: 678,484

[52] U.S. Cl. ..... 208/8

[51] Int. Cl.[2] ..... C10G 1/04

[58] Field of Search ..... 208/8, 10

[56] References Cited

UNITED STATES PATENTS

| | | | |
|---|---|---|---|
| 2,476,999 | 7/1949 | Orchin | 208/8 |
| 3,535,224 | 10/1970 | Corey et al. | 208/8 |
| 3,791,956 | 2/1974 | Gorin et al. | 208/10 |
| 3,852,183 | 12/1974 | Snell | 208/8 |
| 3,997,425 | 12/1976 | Gatsis et al. | 208/8 |

*Primary Examiner*—Delbert E. Gantz
*Assistant Examiner*—James W. Hellwege
*Attorney, Agent, or Firm*—Richard J. Hicks

[57] ABSTRACT

A process for removing mineral matter from a solubilized coal slurry while retaining the asphaltenes with the coal solution in which the slurry is agitated with an alkanolamine or other hydrophilic agglomerating agent in the presence of an aromatic solvent or a polyvinyl alcohol, to form relatively large agglomerates which contain substantially all of the mineral matter, the undissolved coal, the agglomerating agent and some entrained coal solution and which can be separated rapidly from the coal solution by gravity settling. The agglomerates can then be washed with a solvent to recover entrained coal solution, which can in turn be distilled to recover solvent, a high boiling coal solution and agglomerating agent for recycling.

12 Claims, 1 Drawing Figure

SOLIDS RECOVERY FROM COAL LIQUEFACTION SLURRY

BACKGROUND OF THE INVENTION

This invention relates to processes for the conversion of carbonaceous solid materials such as coal to clean and valuable hydrocarbon liquids and gases. More specificially, this invention relates to a process for liquefying coal to produce a liquid fuel which is substantially free of the mineral components normally found in coal as well as undissolved coal particles.

It has long been known that hydrocarbon gases, liquids, pitch and/or chemicals can be obtained from coal, which is mined in vast quantities in many parts of the world. Heretofore, the prior art has employed generally destructive distillation processes for the conversion of coal to the desired products. More recently, the art has developed high pressure hydrogenation and solvent extraction techniques to effect the conversion. The solvent extraction technique in which the coal is contacted with a selective solvent and subsequently hydrogenated and distilled appears particularly promising but the procedures thus far adapted all suffer from the problem of removing the mineral matter always associated with coal, commonly referred to as "ash", as well as finely divided, undissolved coal. It has been found that if this contaminating mineral matter is not removed from the extract, considerable processing difficulties occur in subsequent treating or recovery procedures, particularly in the subsequent hydrogenation processes which utilize a catalyst. The mineral matter tends to deposit on the catalyst causing rapid deactivation or poisoning of the catalyst.

Numerous techniques for removing the mineral matter and undissolved coal have been suggested including filtration, hydroclones, centrifuging, distillation, fluid coking, settling, water washing, electrostatic precipitation, solvent precipitation, and foam flotation, and the patent literature describes many of these techniques in detail. With the exception of vacuum distillation all of these methods are relatively ineffectual for the removal of particles in the submicron range. Even with distillation the erupting surface of the coal solution permits suspended small particles to be carried over with the distillate. Solvent precipitation, which is the subject of many patents of which U.S. Pat. No. 3,791,956 issued Feb. 12, 1974 to Gorin et al is illustrative, is relatively expensive to perform and rather slow, usually requiring many hours of centrifuging or several days of gravity settling. Generally solvent precipitation techniques are based upon the use of a precipitating solvent, sometimes called an antisolvent, to effect agglomeration of the finely divided solids by precipitating asphaltenes, contained within the liquefied coal slurry, onto the surface of the finely divided solids causing them to stick together and form small, loosely structured agglomerates which enhance the settling rate. Asphaltenes, which are defined as benzene soluble and n-pentane insoluble materials in coal extracts, are barely soluble in the coal solvent and insoluble in the short chain organic precipitating solvent, and they are precipitated because of the high mutual solubility of the short chain solvents with the coal solvent and some solution components. As a portion of the asphaltenes, which make up the high boiling point fraction of solubilized coal and can range as high as 40% by weight of the solubilized coal, end up in the tailings the yield of solubilized coal is considerably reduced unless efforts are made to recover them. Solvent extraction with solvents such as benzene or tetrahydrofuran is effectively the only practical method and this has the disadvantage that it frees the individual solid particles again and the problem of separation again occurs.

BRIEF SUMMARY OF THE INVENTION

It is an object of the present invention, therefore, to provide a process for the maximum recovery of solubilized coal containing substantially all of the asphaltenes and which is substantially free of solids.

Thus, by one aspect of this invention there is provided in a coal liquefaction process which employs a coal liquefaction solvent wherein a product is recovered which contains a solution of coal liquefaction products in said liquefaction solvent as a first component and finely divided undissolved solids as a second component, the improvement for separating said second component from said first component by agglomeration while retaining substantially all asphaltenes contained in said product in said first component which comprises:

a. agitating said product, in an agglomeration zone, with i. a hydrophilic agglomeration agent selected from the group comprising short chain organic compounds containing 2–8 carbon atoms and two or more functional groups selected from OH, COOH, C=O, $NH_2$, NH, N, $ONH_4$, and $SO_3$, and mixtures thereof, in the presence of ii. an immiscibilizing agent selected from a polyvinyl alcohol and an aromatic solvent which renders said agglomeration agent immiscible in said solution, while maintaining the temperature and pressure sufficiently high to keep the mixture fluid, so as to effect agglomeration of said second component;

b. separating at least a major portion of said first component from agglomerated said second component; and c. recovering said agglomeration agent and entrained said first component from said agglomerated second component.

The invention will be described more fully hereinafter with reference to the drawing in which:

DETAILED DESCRIPTION OF THE INVENTION

Figure 1:
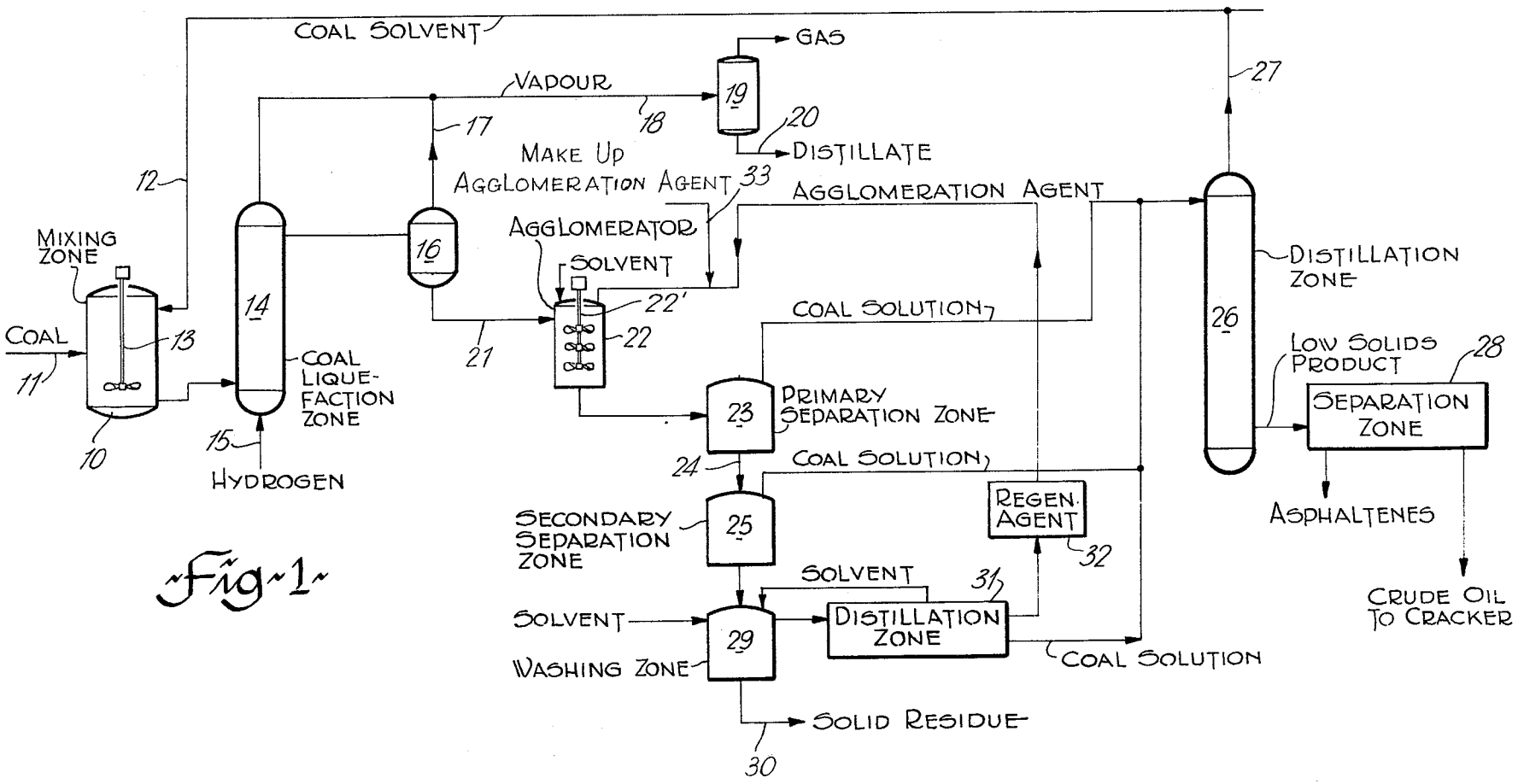
FIG. 1 is a schematic flowsheet of one embodiment of the process of the present invention.

The term coal as used herein means any form of naturally occurring solid, ash containing hydrocarbonaceous substance and includes such materials as bituminous and sub-bituminous coals, arthracite and lignites.

A suitable coal solvent is a mixture of polycyclic aromatic hydrocarbons which is liquid under the conditions of temperature and pressure for coal liquefaction. The normal boiling range for such a solvent is within the range 250°–425° C and the solvent is preferably a distillate product of the coal itself which may be at least partially hydrogenated.

Referring to FIG. 1, finely divided coal and a commercially available coal solvent are introduced into a mixing zone 10 through lines 11 and 12 respectively. The solvent-to-coal ratio is generally between 1 and 4 by weight. An externally powered mixer 13 provides stirring.

The mixture of coal and solvent, now in the form of a slurry is transferred to a liquefaction zone 14 which is known per se and in which any one of many known processes may be employed, usually with the introduction of hydrogen via conduit 15. On leaving the liquefaction zone, the slurry is passed to a liquid-gas separator 16. Any vapour from the liquefaction zone 14 and separator 16 is drawn off via conduits 17 and 18 respectively and passed to a separation zone 19 to separate gas and the condensable vapours which pass to a light distillate line 20.

The aromatic solvent introduced at 22 is conveniently methyl naphthalene or toluene although other aromatics such as benzene, xylene, naphthalene, turpentine, as well as chlorinated hydrocarbon solvents have been found to be useful because they have good solvent power for the coal components, are immiscible in ethanolamines or other agglomerating agents are regarded as non-precipitants for asphaltenes, unlike aliphatic compounds such as pentane, hexane, etc. The amount of the aromatic solvent that is necessary to ensure agglomeration of the solids in the coal liquefaction slurry with alkanolamines or other agglomerating agent is thought to depend on the amount of nitrogen or sulphur containing compounds present that are miscible in the agglomerating agent which in turn depends on the abundance of nitrogen and sulphur atoms in both the coal and the coal solvent used. Generally 5 to 20% by weight based on the coal liquefaction slurry is sufficient. As an alternative to the use of an aromatic solvent it has been found that a low percentage of polyvinyl alcohol dissolved in the ethanolamine used as the agglomerating agent, is equally effective. In this case, it is believed that the highly hydroxylated compound dissolved in the ethanolamine renders it immiscible with nitrogen and sulphur containing compounds also. Water and other hydroxylated compounds are generally ineffective because they either emulsify or dissolve in the coal solution.

From the gas-liquid separator 16 the slurry is passed, via conduit 21 to an agglomerator 22 which is provided with an externally powered agitator 22'. An agglomerating agent is introduced via conduit 24 and the slurry and agglomerating agent are agitated for a relatively short time, of the order of 5–20 minutes at a temperature in the range 20°–350° C, providing the coal solution viscosity is not substantially greater than 3000 S.U.S. at the temperature selected. At low temperatures, the viscosity can be reduced if necessary by the addition of an appropriate solvent.

The agglomerating agent selected is generally a hydrophilic short chain organic compound containing between 2 and 8 carbon atoms and having two or more of the following functional groups: OH, COOH, C=O, $NH_2$, NH, N, $ONH_4$ and $SO_3$. The hydroxyl groups contribute to its insolubility in the coal solution and help wet some components such as clay. The agglomerating agent must be immiscible in the coal solution and be readily miscible with water but contain virtually no water. For these reasons ethanolamines such as MEA (monoethanolamine), DEA (di ethanolamine) or TEA (tri ehanolamine) are especially suitable for the purpose. Ethanolamines are almost completely insoluble in non-polar solvents (see Kirk-Othmer Encyclopedia of Chemical Technology 2nd Ed. 1963 — Interscience Publishers) but it is known that some compounds in the coal solution contain nitrogen and sulphur atoms and are probably similar to pyridine, quinoline, benzylamine, benzothiophene and phenothiazine etc., all of which are quite miscible in ethanolamines. It is believed that the addition of the aforementioned aromatic solvent, through agglomerator 22 having a greater affinity for these nitrogen and sulphur containing compounds than for the ethanolamine, renders the ethanolamine immiscible in the coal solution. Similarly, as indicated hereinabove, the addition of hydrolysed polyvinyl alcohol to the ethanolamine renders ethanolamine immiscible in the coal solution. The solubility of alkanolamines in hydrocarbons increases with chain length and the compounds are more expensive so that it has been found that any alkanolamine up to, but not including, betanolamine is an effective agglomerating agent. Other agglomerating agents include:

2-(2-aminoethylamino)-ethanol
1–3 diamino-N-(B-hydroxyethyl) propane
tetramethylammonium hydroxidepentahydrate
ammonium formate
ethanol formamide A mixture of two or more of the above agglomerating compounds with each other, and mixtures of any of the above with urea, polyacrylamide or polyvinylidene chloride may also be employed.

After agitation for 3 to 20 minutes, the contents are transferred to a primary separation zone 23 from which the coal solution may be drawn off. The agglomerates are removed via conduit 24 to a secondary separation zone 25 and allowed to stand therein for 3 to 10 minutes, during which time 1 to 2% of the coal solution is displaced, recovered and combined with the coal solution from the primary separation zone. The coal solution is then distilled in a distillation zone 26, to recover the coal solvent for recycling at 27 and to produce a low solids coal solution which is further treated in a separation zone 28 to remove the asphaltenes, which are directed to industrial uses such as road building materials and roofing compounds, and to prepare a relatively low viscosity crude oil product which can be further processed by catalytic cracking and the like. With abundant small particles removed it will be appreciated that the removal of the asphaltenes with the coal solution for subsequent separation therefrom allows the precipitated particles of asphaltenes to coalesce easily and settle rapidly with only mild agitation in about 10 to 15 minutes by gravity settling, especially when the viscosity is below 3000 S.U.S.

The agglomerates, now separated from the bulk of the coal solution, only contain the solid materials, the agglomerating agent and some residual entrapped coal solution. The agglomerating agent and the entrapped coal solution may be recovered by any of several methods. One method is to distil off the agglomerating agent and any coal solution that distils readily, and subsequently, gasify the remaining portion supplemented by raw coal as necessary, to produce hydrogen for the coal liquefaction stage. Another method is to wash out the agglomerating agents with a suitable aqueous or organic solvent such as methanol, ethanol, propanol, isopropanol, benzylalcohol, acetone or tetrahydrofuran in a washing zone 29, as shown in FIG. 1. The solid residue 30 may be treated as noted above for the production of hydrogen. The solvent—coal solution—agglomerating agent wash solution is treated in a low temperature distillation zone 31 to recover the solvent for recycling, the agglomerating agent for recycling and the coal solution for treating in a known manner. A modified procedure can be used by adding about 5% more agglomerating agent, based on the solids, than the minimum requirement. In this case, especially with conditioners like the ethanolamines, the agglomerates flow together to form a separate liquid phase, denser and immiscible with the supernatent liquid (coal solution). Separation of the liquids can then be achieved by pumping or siphoning. The subsequent procedure of separating the agglomerating agent and entrapped coal solution from the solids remains unchanged. It is believed that the agglomerating agents strongly wet some and react with other surface constituents of the heterogeneous small particles, displacing the coal solution from these surfaces. It is also believed that some alkanolamine complexes form with components of the coal solution and become miscible in the coal solution, thus increasing the amount of alkanolamine required for agglomeration. It is, therefore, desirable to break down or prevent these complexes from forming. It has been found that bases stronger than alkanolamines break up alkanolamine complexes and convert them back to alkanolamines. These regenerating compounds 32 can be added concurrently with the agglomerating agent or at the recycling stage. One to three percent by weight based on the solids in the C.L.S. of a base such as NaOH, KOH, $Na_2CO_3$ or $K_2CO_3$ reduce the amount of alkanolamine required for agglomeration by about 40%. Make-up agglomerating agent may be added at 33 and with the recovered agglomerating agent is recycled to the agglomerator 22.

EXAMPLE 1

A coal liquefaction slurry (C.L.S.) containing 16.4% solids and having an ash value of 3.4% was diluted with 20% toluene thereby reducing the solids content to 13.6% and the ash value to 2.83%. One hundred parts of the above diluted C.L.S. and 24 parts by weight of monoethanolamine (MEA) based on solids were heated in a closed container to 70° C and agitated in a paint shaker for about 10 minutes. It was found that all the solids were agglomerated into lumps ⅛ inch – ½ inch in diameter. The cleaned coal solution was then decanted and the agglomerates were allowed to stand in theclosed container at 70° C for 10 minutes during which time the agglomerates displaced more coal solution which was again decanted and added to the bulk solution. The agglomerates were then dispersed in tetra hydrofuran using mild agitation, collected on a No. 1 filter paper and washed three times with tetra hydrofuran. The washed solids were air dried at 90° C and subsequently ashed at 600° to 650° C. The tetra hydrofuran washings were then distilled, collecting first the tetra hydrofuran and a trace of toluene and secondly the MEA leaving most of the higher boiling coal solution product behind in the container. It was estimated that approximately 60% of the MEA was recovered. The MEA was reused and found to be active. Similar results were obtained by substituting methanol for tetra hydrofuran as the washing solvent. The results obtained are tabulated hereinbelow in Example 1, Table 1.

EXAMPLES 2–23

The procedures of Example 1 were repeated with four different coal liquefaction slurries using a wide range of temperatures and several different agglomerating agents and regeneration compounds. In some experiments the agglomerates were collected on screens 4 to 60 mesh size, in others the agglomerates were separated from the coal solution and subsequently distilled to remove the agglomerating agent and the low boiling portion of the coal solution. The results are tabulated hereinbelow as Examples 2–23 in Table 1.

| No. | Agglomeration Additive | Regeneration Compound | Temp. 0°C | Coal Liquefaction Slurry Used | Total Solids in Diluted C.L.S. | Ash Value of Diluted C.L.S. | Primary Recovery of Cleaned Coal Solution | Coal Solution Recovered From Agglomerate | Total Recovery of Coal Solution | Ash Value of Cleaned Coal Solution | Reduction of Ash | Ash Value of Solids in Mashed Agglomerate |
|---|---|---|---|---|---|---|---|---|---|---|---|---|
| 1 | 24% M.E.A | — | 70 | 100 parts of a mixture composed of 100 parts A+20 parts toluene | 13.6% | 2.83 | 94.9 | 3% aprox. using methyl alcohol | 98% approx. | .017 | 99.4 | 27.4 |
| 2 | 24% D.E.A. | — | 70 | 100 parts of a mixture composed of 100 parts A+10 parts toluene | 14.9% | 3.1 | 92.3 | — | — | .017 | 99.5 | 27.1 |
| 3 | 24% D.E.A. | — | 300 | 100 parts of a mixture composed of 100 parts A+20 parts methylnaphthalene | 13.6% | 2.83 | 94.4 | — | — | .018 | 99.4 | 26.1 |
| 4 | 24% D.E.A. | — | 70 | 100 parts of a mixture compound of 100 parts A+20 parts benzene | 13.6% | 2.83 | 95.9 | 3% approx. using T.N.F. wash | 99% approx. | .016 | 99.4 | 26.5 |
| 5 | 24% T.E.A. | — | 60 | 100 parts of a mixture composed of 100 parts A+20 parts xylene | 13.6% | 2.83 | 92.9 | — | — | .038 | 96.7 | 25.2 |
| 6 | 24% M.E.A. | — | 130 | as above | 13.6% | 2.83 | 95.9 | 1.2% by distillation | 97% approx. | .014 | 99.4 | 26.2 |
| 7 | 24% M.E.A. | — | 30 | as above | 13.6% | 2.83 | 94.4 | 3.0% approx. methyl alcohol | 97.5% approx. | .015 | 99.5 | 25.1 |
| 8 | 50/50 MEA/DEA | — | 70 | 100 parts of a mixture composed of 100 parts A+20 toluene | 13.6% | 2.83 | 94.4 | — | — | .015 | 99.5 | 25.5 |
| 9 | 24% 2-(2 amino-ethylamino) ethanol | — | 70 | 100 parts of a mixture composed of 100 parts A+20 toluene | 13.6% | 2.83 | 94.1 | — | — | .026 | 99.1 | 26.6 |
| 10 | 24% ethanol-formamide | — | 180 | 100 parts of a mixture composed of 100 parts A+20 parts xylene | 13.6% | 2.83 | 94.8 | — | — | .018 | 99.4 | 26.3 |
| 11 | 15% M.E.A. | 4.0%(based on solids) of 150% NaOH is $H_2O$ | 30 | 100 parts of a mixture composed of 100 parts A+20 parts xylene | 13.6% | 2.83 | 91.9 | — | — | .017 | 99.4 | 27.6 |
| 12 | 15% M.E.A. | as above | 90 | as above | 13.6% | 2.83 | 95.7 | — | — | 0.23 | 99.2 | |
| 13 | 15% M.E.A. | 5%(based on solids) of 130% $K_2CO_3$ in $H_2O$ | 180 | 100 parts of mixture composed of 100 parts A+20 parts methylnaphthalene | 13.6% | 2.83 | 96.8 | — | — | .026 | 99.1 | 27.1 |
| 14 | 15% M.E.A. | 6% (based on solids) of 110% KOH in $H_2O$ | 70 | 100 parts of a mixture composed of 100 parts A+20 parts toluene | 13.6% | 2.83 | 96.7 | — | — | .023 | 99.2 | 23.8 |
| 15 | 15% M.E.A. | 3% (based on solids) of NaOH freshly ground powder (no $H_2O$) | 70 | as above | 13.6% | 2.83 | 95.8 | 3.3% methyl alcohol | 99% approx. | .024 | 95.2 | 27.4 |
| 16 | 13% M.E.A. | 7% (based on solids) of $Na_2CO_3.12\ H_2O$ | 70 | as above | 13.6% | 2.83 | 95.2 | — | — | .030 | 99.0 | 27.1 |
| 17 | 24% of a 4% solution of hydrolized poly-vinyl alcohol in M.E.A. | — | 180 | 100 parts A (no dilution) | 16.4% | 3.4 | 92.7 | — | — | .032 | 99.1 | 26.5 |
| 18 | as above | — | 300 | 100 parts A (no dilution) | 16.4% | 3.4 | 91.9 | — | — | .038 | 96.9 | — |
| 19 | 24% M.E.A. | — | 70 | 100 parts of a mixture composed of 100 parts B+10 parts toluene | 13.1% | 2.7 | 95.7 | — | — | .02% | 99.0 | 25.6 |
| 20 | 15% M.E.A. | 5% (based on solids) of 130% $K_2CO_3$ is $H_2O$ | 200 | 100 parts of a mixture composed of 100 parts B+10 parts of 1-methyl-naphthalene | 13.1% | 2.7 | 96.2 | — | — | .031 | 96.9 | 26.1 |
| 21 | 25% M.E.A. | — | 90 | centrifuged solids dispersed in mixture composed of 100 parts of commercial coal solvent and 20 parts toluene | 14.5% | 9.1 | 92.0 | — | — | .030 | 99.2 | 56.1 |
| 22 | 15% M.E.A. | 5% (based on solids) of 130% $K_2CO_3$ is $H_2O$ | 180 | centrifuged solids dispersed in mixture composed of 100 parts of commercial coal solvent and 20 parts 1-ethylnaphthalene | 14.5% | 9.1 | 91.6 | — | — | .022 | 98.8 | 55.6 |
| 23 | 15% M.E.A. | 4% (based on solids) of | 200 | 90 parts D+10 parts | 18.2% | 5.2 | 90.4 | — | — | .026 | 99.7 | 29.4 |

-continued

| No. | Agglomeration Additive | Regeneration Compound | Temp. 0°C | Coal Liquefaction Slurry Used | Total Solids in Diluted C.L.S. | Ash Value of Diluted C.L.S. | Primary Recovery of Cleaned Coal Solution | Coal Solution Recovered From Agglomerate | Total Recovery of Coal Solution | Ash Value of Cleaned Coal Solution | Reduction of Ash | Ash Value of Solids in Mashed Agglomerate |
|---|---|---|---|---|---|---|---|---|---|---|---|---|
| | | | | methylnaphthalene | | | | | | | | |

Note:
C.L.S. - Coal Liquefaction Slurry
A - pilot plant source of C.L.S. containing 16.4% solids and 3.4% ash
B - pilot plant source of C.L.S. containing 14.4% solids and 32 ash
C - paste obtained from centrifuging C.L.S. product
D - C.L.S. product obtained by dissolution of high ash Western Canadian bituminous coal With reference to Table 1 it will be apparent from the low ash values obtained that the coal solution was well cleaned. The small amount of ash remaining is probably due mostly to metal organic compounds soluble in the coal solution such as porphyrins. It is to be noted that the regeneration compounds were added without water or in concentrated solutions in order to keep the water content in the system below the critical level of about 1–1.5%. Above this amount some emulsification takes place and discreet large agglomerates do not form. Example 15 used freshly ground NaOH powder and Example 16 used a hydrated compound $Na_2CO_3$,-$10H_2O$ which becomes liquid above 32° C. Examples 17 and 18 were carried out on C.L.S. as received from a pilot plant and were not diluted. The separations were only possible because of the use of a hydrolysed polyvinyl alcohol as described heretofore. The suspensions used in examples 21 and 22 were made from a pilot plant product that had been centrifuged at source. It was in the form of a stiff paste containing about 40% coal solution and had a high ash content. It was dispersed in a commercial coal solvent with either toluene or methyl naphthalene present. Considerable agitation was required for dispersion in the medium, probably due to a high concentration of asphaltenes. The C.L.S. used in Example 23 was obtained from a high ash Canadian bituminous coal and only about 50% of the coal was solubilized.

We Claim:

1. In a coal liquefaction process which employs a coal liquefaction solvent wherein a product is recovered which contains a solution of coal liquefaction products in said liquefaction solvent as a first component and finely divided undissolved solids as a second component, the improvement for separating said second component from said first component by agglomeration while retaining substantially all asphaltenes contained in said product in said first component which comprises:

a. agitating said product, in an agglomeration zone, with i. a hydrophilic agglomeration agent selected from the group comprising short chain organic compounds containing 2–8 carbon atoms and two or more functional groups selected from OH, COOH, C=O, $NH_2$, NH, N, $ONH_4$ and $SO_3$, and mixtures thereof, in the presence of ii. an immiscibilizing agent selected from a polyvinyl alcohol and an aromatic solvent which renders said agglomeration agent immiscible in said solution, while maintaining the temperature and pressure sufficiently high to keep the mixture fluid, so as to effect agglomeration of said second component;

b. separating at least a major portion of said first component from agglomerated said second component; and c. recovering said agglomeration agent and entrained said first component from said agglomerated second component.

2. A process as claimed in claim 1 wherein said agglomerated second component is washed with a solvent to thereby recover said agglomeration agent and said entrained first component, and wherein said agglomeration agent, first component and said organic solvent are separated by distillation.

3. A process as claimed in claim 2 wherein said solvent is selected from the group consisting of methanol, ethanol, propanol, isopropanol, benzylalcohol, acetone and tetrahydrofuran.

4. A process as claimed in claim 1 wherein additional agglomeration agent is added in an amount sufficient to form said agglomerated second component as a liquid phase.

5. A process as claimed in claim 1, wherein said agglomeration agent is selected from the group consisting of: methanolamines; ethanolamines; propanolamines; 2-(2-amino-ethylamino)-ethanol; 1-3 diamino-N-(B-hydroxyethyl)propane; tetramethylammonium hydroxide penta hydrate; ammonium formate; ethanol formamide and mixtures thereof; and mixtures of any of the foregoing with urea, polyacrylamide or polyvinylidene chloride.

6. A process as claimed in claim 5 wherein said agglomeration agent is at least one ethanolamine.

7. A process as claimed in claim 1 wherein said immisciblizing agent is an aromatic solvent.

8. A process as claimed in claim 7, wherein said aromatic solvent is selected from the group comprising: benzene, toluene, xylene, naphthalene, methylnaphthalene, turpentine, chlorinated hydrocarbon compounds and mixtures thereof.

9. A process as claimed in claim 1, wherein recovered agglomeration agent from step (*c*) is an alkanolamine and is regenerated by addition of a base stronger than alkanolamine.

10. A process as claimed in claim 9, wherein said base is selected from the group comprising KOH, NaOH, $K_2CO_3$ and $Na_2CO_3$ and said alkanolamine is recycled to step (*a*).

11. A process as claimed in claim 1 wherein said first component recovered in step (*b*) is distilled to recover said coal liquefaction solvent and a substantially ash free product containing substantially all said asphaltenes.

12. A process as claimed in claim 11, including the step of separating said asphaltenes from said ash free product.

* * * * *

UNITED STATES PATENT AND TRADEMARK OFFICE

CERTIFICATE OF CORRECTION

PATENT NO. : 4,029,567

DATED : June 14, 1977

INVENTOR(S) : Joseph Redmond Farnand and Ira Edwin Puddington

It is certified that error appears in the above-identified patent and that said Letters Patent are hereby corrected as shown below:

Column 4, line 14 , "betanolamine" should read --butanolamine--;

Column 7 and Column 9, the heading in the last column in the Table, "Mashed" should read --Washed--;

Column 7, in the Table, item 4 in the column head "Coal Liquefaction Slurry Used", "compound" should read --composed--;

Column 7, in the Table, in the column headed "Coal Solution Recovered From Agglomerate", "T.N.F." should read --T.H.F.--;

Columns 7, 8 and 9, in the Table, in the column headed "Regeneration Compound" in items 11, 20 and 22, "is" should read --in--;

Column 9, item 23, in the column headed "Regeneration Compound" after "4% (based on solids) of" the omitted phrase "150% NaOH in $H_2O$" should be inserted; and Column 9, in the Table, in the column headed "No." --23-- should be inserted.

Signed and Sealed this

*Twenty-fifth* Day of *October 1977*

[SEAL]

*Attest:*

RUTH C. MASON
*Attesting Officer*

LUTRELLE F. PARKER
*Acting Commissioner of Patents and Trademarks*